US006039272A

United States Patent [19]

Ren et al.

[11] Patent Number: 6,039,272

[45] **Date of Patent: *Mar. 21, 2000**

[54] SWIRL GENERATOR IN A FUEL INJECTOR

[75] Inventors: Wei-Min Ren, Yorktown; David Wieczorek, Newport News, both of Va.

[73] Assignee: Siemens Automotive Corporation, Auburn Hills, Mich.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/259,168

[22] Filed: Feb. 26, 1999

Related U.S. Application Data

[63] Continuation of application No. 08/795,672, Feb. 6, 1997, Pat. No. 5,875,972.

[51] Int. Cl.[7] ..... B05B 1/34; F02M 51/06; F02M 61/04

[52] U.S. Cl. ..... 239/597; 239/585.4; 239/497

[58] Field of Search ..... 239/585.1–585.5, 239/463, 462, 472, 473, 494, 496, 497

[56] References Cited

U.S. PATENT DOCUMENTS

| | | | |
|---|---|---|---|
| 2,273,830 | 2/1942 | Brierly | 239/472 |
| 5,207,384 | 5/1993 | Horsting | 239/463 |

FOREIGN PATENT DOCUMENTS

| | | | |
|---|---|---|---|
| 2-241973 | 9/1990 | Japan | 239/585.4 |

*Primary Examiner*—Kevin Weldon

[57] ABSTRACT

A high pressure fuel injector has a swirl generator with a metering disk upstream of the valve seat. The disks function to redirect the axially flowing fuel through the injector into a tangential fuel flow. As the fuel moves past the needle valve and the valve seat, the narrow cross section imparts a higher velocity to the fuel to atomize the fuel. As the fuel leaves the swirl generator and is ejected from the injector, the fuel forms a hollow conical sheet containing atomized fuel.

20 Claims, 2 Drawing Sheets

SWIRL GENERATOR IN A FUEL INJECTOR

This application is a continuation of U.S. application Ser. No. 08/795,672 filed Feb. 6, 1997, now U.S. Pat. No. 5,875,972,

FIELD OF INVENTION

This invention relates to fuel injectors in general and particularly direct injection fuel injectors and more particularly to a swirl generator for generating a hollow cone fuel spray being ejected from the injector.

BACKGROUND OF THE INVENTION

Fuel spray preparation is very important as it provides a means to have much finer droplets of fuel being ejected into the engine. U.S. Pat. No. 5,114,077 issued on May 19, 1992 to Mark Cerny and entitled "Fuel Injector End Cap" is assigned to a common assignee, is concerned about the prevention of fuel seepage from the end cap of a high pressure injector. However, it describes a spray generator in a high pressure fuel injector. A high pressure fuel injector has the fuel at pressures exceeding 4.0 Bar.

In '077 patent the spray generator is displaced adjacent and upstream from the valve seat member and has a plurality of passageways ending in an inclined passageway which directs the fuel tangential to the needle valve upstream of the sealing ring of the valve in the valve seat member.

Another U.S. Pat. No. 5,207,384 issued on May 4, 1993 to John J. Horsting and entitled "Swirl Generator For An Injector" is also assigned to a common assignee. In this patent the swirl generator is located adjacent to the outlet orifice of the injector. The swirl generator is a two piece device that is located in the conical valve seat and operates to direct the fuel tangentially to the valve seat. The function of the swirl generator is to impart a tangential flow to the fuel and to minimize the amount of residual fuel in the injector prior to opening.

A third patent, U.S. Pat. No. 5,271,563 issued on Dec. 21, 1993 to Cerny et al and entitled "Fuel Injector With A Narrow Annular Space Fuel Chamber" is assigned to Chrysler Corporation. This patent teaches a high pressure fuel injector wherein the fuel is directed tangentially to a volume surrounding the needle valve upstream of the valve seat. When the valve opens, this amount of fuel leaves the space and subsequent amounts of fuel are tangentially directed to the to needle valve and have a swirling motion imparted to the fuel.

SUMMARY OF THE INVENTION

It is a principle advantage of the invention to develop a fine hollow cone shaped fuel discharged from the fuel injector.

It is another advantage of the invention to control high pressure fuel flowing into the cylinder of an internal combustion engine and to do so with a resulting finely atomized fuel to increase combustion of the fuel in the cylinder.

These and other advantages will become apparent from the swirl generator in a high pressure fuel injector. The high pressure fuel injector has a housing with an inlet end for receiving fuel, an outlet end for ejecting fuel into the cylinder of the engine. The injector valve body has an inlet end and an outlet end with an axially extending fuel passageway from the inlet end to the outlet end which is in fluid communication with the inlet of the housing.

An armature coupled to a stator and is responsive to the energization of an electromagnetic source, being a coil wound around a bobbin and connected to an electronic control unit for axially moving in a reciprocating manner the armature along the axis of said valve body. A valve seat member is located at the outlet end of the valve body; and forms a sealing fit with the valve body either by a material to material fit or by means of a sealing member such as an O-ring. The valve seat member has an axially extending fuel passageway; between its upstream and downstream surfaces.

A needle valve is coupled to the armature and operates to open and close the fuel passageway in the valve seat member for inhibiting fuel flow therethrough. One or more metering disks form a swirl generator causing the fuel to form a hollow cone shaped fuel flow exiting from the injector. The swirl generator is connected to the upstream side of the valve seat member for providing a tangential flow path to fuel flowing from the fuel passageway in the valve body to the fuel passageway of the valve seat member. The fuel passageway of the valve seat member has a conical annulus extending between the upstream side and the downstream side of the valve seat member. A curved surface on the needle valve mates with the conical annulus on a circular band thereon. The circular band is in effect a single circumferential line on the surface for mating the needle valve and the valve seat to inhibit fuel flow through the valve seat. The band is located intermediate the upstream side of valve seat and the upstream opening of the axially extending opening in the valve seat. When the needle valve is removed from the valve seat, the very small cross sectional opening between the valve and the valve seat causes an increase in the fuel velocity which causes atomization of the fuel as it flows into the cone shaping area of the valve.

These and other advantages will become apparent from the following drawings taken in conjunction with the detailed description of the preferred embodiment of the invention.

DETAILED DESCRIPTION OF THE PREFERRED EMBODIMENT

Figure 1:
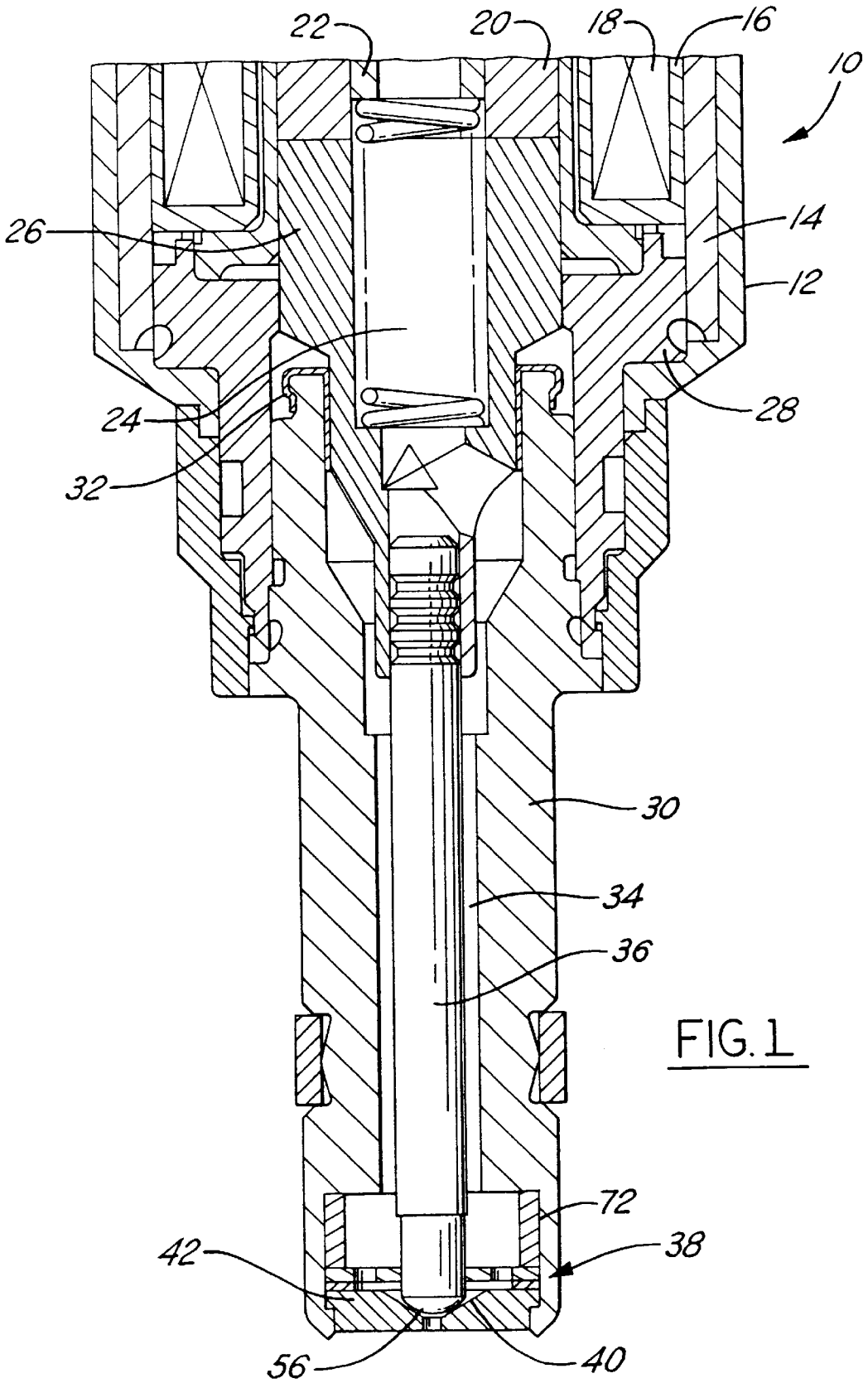
FIG. 1 is a partial section view of a fuel injector taken along its longitudinal axis.

Referring to the Figures by the characters of reference there is illustrated in FIG. 1 the longitudinal cross section of a high pressure fuel injector 10 according to the present invention. Not shown in FIG. 1, for the purposes of clarity, is the fuel inlet with an in-line fuel filter and an adjustable fuel inlet tube which is longitudinally adjustable to vary the length of the armature bias spring. In addition, there is a connector for connecting the solenoid coil to a source of electrical potential and an O-ring for sealingly connecting the fuel inlet with a fuel rail or fuel supply member.

Referring to FIG. 1, there is illustrated the plastic overmold member 12, the housing member 14, the bobbin 16 with the coil 18 wound therearound, the inlet tube or stator 20, the adjusting tube 22, the armature bias spring 24, the armature 26, the valve body shell 28, the valve body 30, the upper armature guide eyelet 32, the fuel passageway 34 through the valve body, the needle valve 36, the swirl generator 38 and the valve seat 40 in the valve seat member 42. The fuel outlet of the injector is the outlet of the fuel passageway in the valve seat.

FIG. 1 illustrates a high pressure fuel injector with a swirl generator 38. The fuel injector 10 has an overmolded plastic member 12 encircling a metallic housing member 14. The housing member 14 encloses an electromagnetic source having a bobbin 16 with a coil 18 wound therearound. The ends of the coil 18 are connected through a connector to a source of electrical potential, such as an electronic control unit (ECU). At the top end of the inlet tube 20 which also functions as the stator, is an in-line filter for filtering out particles from the source of fuel. Inside the inlet tube 20 is an adjusting tube 22 which is used to adjust the fluid flow of the injector.

A valve body 30 is enclosed by a valve body shell 28 and has an upper armature guide 32 eyelet on its inlet end. An axially extending fuel passageway 34 connects the inlet end of the injector with the outlet end of the valve body 30 which terminates at a valve seat member 42. Fuel flows in fluid communication between the inlet end of the housing and the valve seat member 42.

The armature 26 is magnetically coupled to the inlet tube or stator 20 near the inlet end of the valve body 30. The armature 26 is guided in its reciprocal motion by the armature guide 32 eyelet and is responsive to an electromagnetic force generated by the coil 18 assembly for axially reciprocating the armature along the longitudinal axis of the valve body 30. The electromagnetic force is generated by current flow from an ECU through the connector to the ends of the coil 18 wound around the bobbin 16.

The valve seat member 42 at the outlet end of the valve body 30 forms a sealing fit with the valve body 30 at the end of an axially extending fuel passageway 34 in the valve body 30. Alternatively an O-ring may be used to form the sealing function. Fuel flows in fluid communication from the fuel inlet, through the filter and along the inside of the adjusting tube 22 and the armature bias spring 24. From the spring 24 the fuel flows into the armature 26 and out an exit to the fuel passageway 34 in valve body 30.

A needle valve 36 is connected or coupled to the armature 26 and operates to open and close the fuel passageway 34 in the valve seat member 42 for inhibiting fuel flow therethrough. One or more disks 44, 46 that form a swirl generator 38 are connected to the to upstream side of the valve seat member 42 for providing a tangential flow path through the lower disk 46 to the valve needle 36. Fuel flows from the fuel passageway 34 to the valve seat member 42.

The fuel passageway in the valve seat member 42 has a conical annulus 50 extending between the upstream side 52 and the downstream side 54 of the valve seat member 42. The needle valve has a curved surface 56, which in the preferred embodiment is a spherical surface although other surfaces may be used, for mating with the conical annulus 50 on a circular band 57 thereon. This circular band 57 lies along the conical annulus 50 or valve seat 40 intermediate the upstream side of the valve seat member 42 and the junction of the conical annulus 50 with the axially extending opening 58 in the valve seat member 42. When the curved surface 56 of the needle valve 36 mates with the circular band 57 on the conical annulus 50 fuel flow is inhibited from flowing through the valve seat 40.

The axially extending opening 58 extends from the apex of the conical annulus 50 to the downstream side of the valve seat member 42. In one embodiment, this is a cylindrical surface with an edge that is a sharper rounded surface, that is a surface having a small radius.

Figure 3:
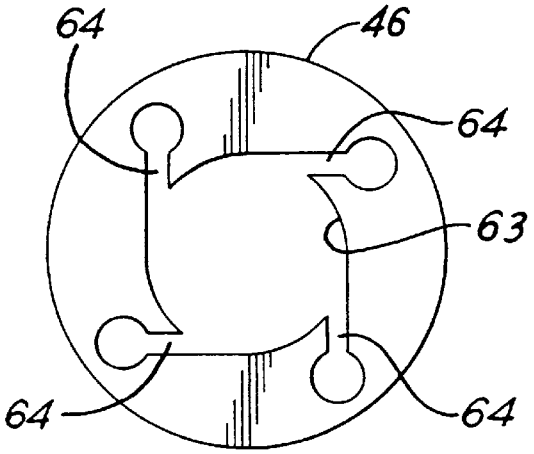
FIG. 3 is a plan view of one of the metering disks.
Figure 4:
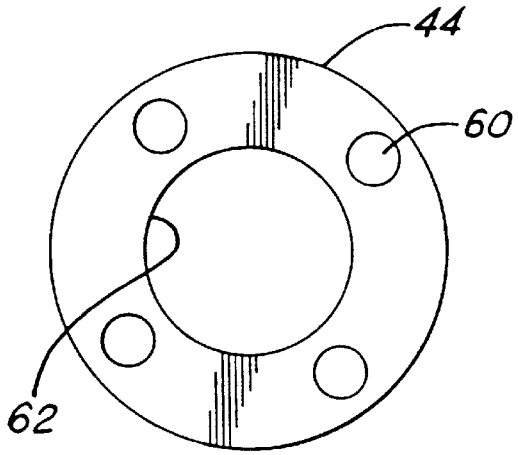
FIG. 4 is a plan view of the guide disk.

The one or more disks 44, 46 comprises an upstream or guide disk 44, shown in FIG. 4, having a plurality of angularly spaced circumferentially extending openings 60 between the perimeter of the disk 44 for supplying fluid to the downstream disk 46, and a central aperture 62 for guiding the needle valve 36. The downstream disk 46, shown in FIG. 3, has a like plurality of slots 64 extending respectively tangentially to the central aperture 63 from four openrngs 64 for metering the fluid, axially aligned with the openings 60 in the upstream disk, for directing and metering the fuel flow from the fuel passageway 34 to the valve seat member 42.

Figure 2:
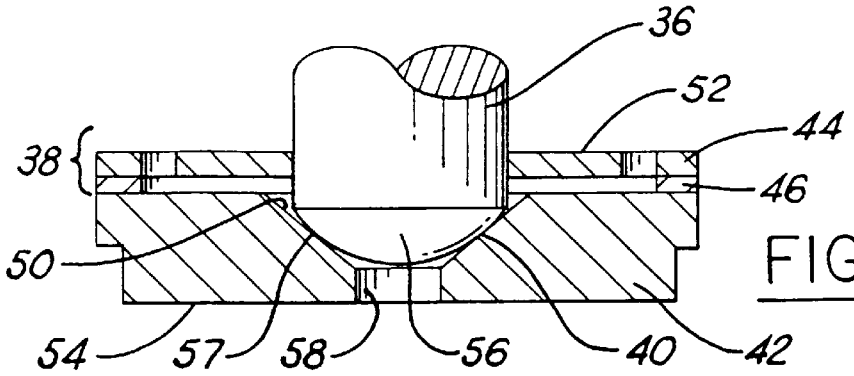
FIG. 2 is an enlarged section view of the valve seat member including the swirl generator.

FIG. 2 illustrates the completed swirl generator 38 mounted on the valve body member 42. The needle valve 36 is shown being guided in the central aperture 62 of the upstream disk 44.

The fuel flowing from the opening 58 in the valve seat member 42 to the fuel outlet of the injector 10, exits in a hollow conical fuel stream. When the injector 10 is actuated, the fuel is fed into the swirl chamber, formed between the needle valve 36 and valve seat 40 and upstream from the circular band 57, through the tangential slots 64 it gains a high angular momentum. The fuel flow strikes the needle valve 36 upstream of the circular band 57. As the fuel continues to flow downstream along the conical annulus 50, its angular velocity increased. This increase in speed functions to atomize the fuel. The fuel then separates from the internal surface of the needle valve 36 due to boundary layer separation. The higher angular velocity combines with the wake region formed behind or downstream from the end of the needle valve 36 to create a stable air-cored vortex. The rotating fuel flows through the outlet opening 58 of the valve seat member 42 and emerges from the valve seat member in the form of an atomized hollow conical sheet of fuel. As the fuel flows through the slots 64 it forms a swirl pattern upstream from the circular band 57 when the needle valve 36 is separated therefrom in response to the reciprocal movement of the armature 26 under the influence of the coil 18.

Figure 5:
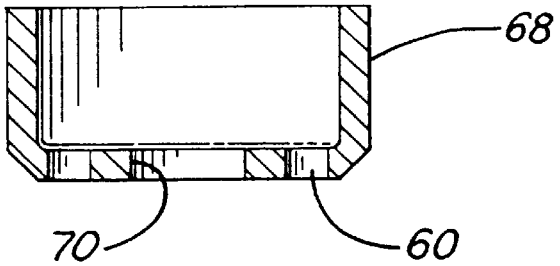
FIG. 5 is an alternate embodiment of the disk of FIG. 4.

Referring to FIG. 5 there is illustrated a cup shaped guide member 68 having an axially aligned central aperture 70 for guiding the needle valve 36 in its reciprocal movement. In FIG. 1, the member 72 is a tubular member positioned to locate the upper disk 44. It is essential that the swirl generator 38 and the valve seat member 42 form a fluid tight assembly, FIG. 2, which is located against the axially extending member portion of the member 68 or 72 and is secured in the injector 10 by securing means such as laser welding.

In the alternative, the one or more metering disks each have an axially aligned central aperture 63. The outer perimeter of the guide disk 44 has a diameter which is less than outside diameter of the valve seat member 42 to assist in the axial positioning of the needle valve 36 and the valve seat 40. It is important that the angularly spaced circumferentially extending openings 60 in the disks 44, 46 are axially in line and the central apertures 62 are aligned.

There has thus been shown a high pressure swirl fuel injector as used in spark-ignited, direct injection gasoline engines. The function of the injector is to disintegrate the proper quantity of fuel into small drops and to discharge them into surrounding gaseous medium in the form of a symmetric uniform spray. Discharge coefficient and spray cone angle are two important characteristics of a swirl injector. The discharge coefficient determines the static flow rate. The cone angle directly affects the liquid film thickness and the extent of the spray exposure to the surrounding air. Normally, an increase in spray cone angle leads to improved atomization, better fuel-air mixing and better dispersion of the fuel drops throughout the combustion volume.

What is claimed is:

1. A fuel injector comprising:

a valve body having an inlet, an outlet, and a fuel passageway extending from the inlet to the outlet along a longitudinal axis;

an armature proximate the inlet of the valve body;

a needle valve operatively connected to the armature;

a valve seat proximate the outlet of the valve body, the valve seat including a first surface, a second surface, and a passage extending between the first surface and the second surface in the direction of the longitudinal axis;

a guide member disposed within the valve body, the guide member including an aperture that guides the needle valve; and a flat metering disk disposed between the valve seat and the guide member, the flat metering disk including a central aperture, a perimeter, an axial thickness, and at least one slot extending from the central aperture toward the perimeter of the flat metering disk, the at least one slot extending through the axial thickness of the flat metering disk.

2. The fuel injector of claim 1, wherein the at least one slot has an entrance located between the central aperture and the perimeter of the flat metering disk.

3. The fuel injector of claim 2, wherein the at least one slot comprises a plurality of slots extending through the axial thickness of the flat metering disk.

4. The fuel injector of claim 3, wherein each of the plurality of slots includes a portion that extends tangentially from a boundary of the central aperture.

5. The fuel injector of claim 3, wherein the flat metering disk further comprises a plurality of apertures extending through the axial thickness of the flat metering disk, the plurality of apertures being equal in number to the plurality of slots so that one of the plurality of apertures communicates with the entrance of one of the plurality of slots.

6. The fuel injector of claim 5, wherein the plurality of apertures is uniformly disposed about the central aperture of the flat metering disk.

7. The fuel injector of claim 6, wherein the guide member comprises a flat disk having a perimeter, a central aperture, and a plurality of openings between the perimeter and the central aperture, the plurality of openings being equal in number to the plurality of apertures so that one of the plurality of openings communicates with one of the plurality of apertures.

8. The fuel injector of claim 1, wherein the guide member comprises a cup-shaped member having a base portion and an axially extending portion.

9. The fuel injector of claim 8, wherein the base portion comprises at least one opening that communicate with the at least one slot.

10. The fuel injector of claim 1, wherein the valve seat includes a fuel passageway having a conical annulus extending between an upstream side of the valve seat and a downstream side of the valve seat; and wherein the needle valve includes a curved surface that mates with the conical annulus to inhibit fuel flow through the passage of the valve seat.

11. The fuel injector according to claim 10, wherein said curved surface on said needle valve is spherical.

12. A fuel injector comprising:

a valve body having an inlet, an outlet, and a fuel passageway extending from the inlet to the outlet along a longitudinal axis;

an armature proximate the inlet of the valve body;

a needle valve operatively connected to the armature;

a valve seat proximate the outlet of the valve body, the valve seat including a first surface, a second surface, a passage extending between the first surface and the second surface in the direction of the longitudinal axis;

a flat metering disk proximate the valve seat and the guide member, the flat metering disk including a central aperture, a perimeter, an axial thickness, and a plurality of slots, each of the plurality of slots extending from the central aperture to a slot entrance to provide a tangential flow path for fuel flowing from the fuel passageway to the passage of the valve seat, the slot entrance being located between the central aperture, the perimeter of the flat metering disk each of the plurality of slots extending through the axial thickness of the flat metering disk; and a guide member proximate the flat metering disk, the guide member having an aperture that guides the needle valve, the guides member being configured to allow fuel to flow from the fuel passageway to the flat metering disk.

13. The fuel injector of claim 12, wherein the flat metering disk further comprises a plurality of apertures extending through the axial thickness of the flat metering disk, the plurality of apertures being equal in number to the plurality of slots so that one of the plurality of apertures communicates with the entrance of one of the plurality of slots.

14. The fuel injector of claim 13, wherein the guide member comprises a flat disk having a perimeter, a central aperture, and a plurality of openings between the perimeter and the central aperture, the plurality of openings being equal in number to the plurality of apertures so that one of the plurality of openings communicates with the entrance of one of the plurality of apertures.

15. The fuel injector of claim 13, wherein the guide member comprises a cup shaped member having a base portion and an axially extending portion, the base portion having a plurality of openings, the plurality of openings being equal in number to the plurality of apertures so that one of the plurality of openings communicates with the entrance of one of the plurality of apertures.

16. A method of providing a swirl generator for a fuel injector, the fuel injector having a valve body having an inlet, an outlet, and a fuel passageway extending from the inlet to the outlet along a longitudinal axis; an armature proximate the inlet of the valve body; a needle valve operatively connected to the armature; a valve seat proximate the outlet of the valve body; and a guide member disposed within the valve body, the guide member including an aperture that guides the needle valve, the method comprising:

providing a metering member including a central aperture, a perimeter, an axial thickness, and at least one slot extending from the central aperture toward the perimeter of the metering member, the at least one slot extending through the axial thickness of the metering member; and locating the metering member between the valve seat and the guide member.

17. The method of claim 16, wherein the metering member comprises a flat disk.

18. The method of claim 17, wherein the flat disk comprises a central aperture, a perimeter, an axial thickness, a plurality of slots, and a plurality of apertures, each of the plurality of slots extending from the central aperture to a slot entrance to provide a tangential flow path for fuel flowing from the fuel passageway to the passage of the valve seat, each of the plurality of slots extending through the axial thickness of the flat disk, each of the plurality of apertures extending through the axial thickness of the flat disk, the plurality of apertures being equal in number to the plurality of slots so that one of the plurality of apertures communicates with the entrance of one of the plurality of slots.

19. The method of claim 17, wherein the guide member comprises a flat disk.

20. The method of claim 17, wherein the guide member comprises a cup-shaped member, the cup-shaped member having a base portion and an axially extending portion.

* * * * *